US006161387A

United States Patent [19]

Green

[11] Patent Number: 6,161,387

[45] Date of Patent: Dec. 19, 2000

[54] MULTISHEAR FUEL INJECTOR

[75] Inventor: John William Green, South Glastonbury, Conn.

[73] Assignee: United Technologies Corporation, Hartford, Conn.

[21] Appl. No.: 09/183,490

[22] Filed: Oct. 30, 1998

[51] Int. Cl.[7] ..... F02C 1/00

[52] U.S. Cl. ..... 60/748; 60/742

[58] Field of Search ..... 60/740, 742, 748

[56] References Cited

U.S. PATENT DOCUMENTS

| | | | |
|---|---|---|---|
| 3,915,387 | 10/1975 | Caruel et al. | 239/400 |
| 3,937,011 | 2/1976 | Caruel et al. | 60/748 |
| 5,062,792 | 11/1991 | Maghon | 431/284 |
| 5,603,211 | 2/1997 | Graves | 60/39.06 |
| 5,660,045 | 8/1997 | Ito et al. | 60/737 |
| 5,737,921 | 4/1998 | Jones et al. | 60/740 |
| 5,833,141 | 11/1998 | Bechtel, II et al. | 239/406 |
| 5,865,024 | 2/1999 | Kress et al. | 60/39.463 |
| 5,983,642 | 11/1999 | Parker et al. | 60/737 |
| 6,035,645 | 3/2000 | Bensaadi et al. | 60/742 |
| 6,038,864 | 3/2000 | Prade et al. | 60/748 |

*Primary Examiner*—Charles G. Freay
*Assistant Examiner*—Robert Z. Evora
*Attorney, Agent, or Firm*—Norman Friedland

[57] ABSTRACT

A fuel/mixer injection system for a combustor of a gas turbine engine comprising two major assemblies including a burner-mounted swirler with two outer air passages surrounding a central passage and a piloted air fuel nozzle containing a main fuel injection orifice and a pilot fuel injection orifice the main fuel mixes with swirling air in the central passage and the pilot fuel mixes with the swirling air in the outer air passage. In another embodiment, the piloted fuel nozzle contains an airblast-atomized main fuel injector annulus and a concentric ring with a plurality of circumferentially spaced holes feeds air to the main fuel injector annulus.

6 Claims, 4 Drawing Sheets

MULTISHEAR FUEL INJECTOR

This invention was made under a Government contract and the United States Government has an interest herein.

TECHNICAL FIELD

This invention relates to fuel injectors for gas turbine engines and more particularly to fuel injectors that combine the fuel and air in a judicious manner for admission into the combustion zone of a combustor for a gas turbine engine.

BACKGROUND OF THE INVENTION

Scientist and engineers have been exploring many different types of fuel injector systems for gas turbine engines in order to meet cycle goals for advanced engines and particularly for future gas turbine engines that are capable of performing at ever increasing overall fuel loading conditions during high-power operations. Because the high fuel loadings at high power conditions dictate an extreme fuel/air ratio at the front end of the combustor these systems have a high propensity for producing smoke. These high fuel/air ratio conditions obviously produce an undesirable amount of soot that needs be eliminated or minimized in one way or another. One method of minimizing soot formation is to oxidize this primary zone soot to acceptable levels and in order to accomplish this feat an increase in the length of the intermediate zone of the combustor is necessary. The increased length, obviously, increases the overall combustor length with a consequence in increased combustor and engine size and a corresponding increase in weight. The increased size and weight in light of future aircraft requirements are intolerable conditions that need to be avoided in order to assure that the engine meets certain thrust to weight specification and of course, meet engine performance requirements.

U.S. Pat. No. 5,603,211 granted to Graves on Feb. 18, 1997 entitled "Outer Shear Layer Swirl Mixer For A Combustor" exemplifies a system that attempts to resolve the high fuel loading conditions at high power by providing localized high front-end fuel/air ratios while attempting to reduce smoke and maintaining or improving on the flame relight stability of the combustor. Other examples of concepts designed for the same purpose are disclosed in U.S. patent application Ser. No. 08/947,554 filed by Graves et al, entitled Fuel Injector For Gas Turbine Engine and Ser. No. 08/947,593 filed by Graves both on Oct., 9, 1997 and all being commonly assigned to United Technologies Corporation, the Assignee of this patent application. All these references are incorporated herein by reference and should be referred to get a better understanding of the details of the fuel nozzle and mixers that are being considered in this application.

As one skilled in this field of technology recognizes, in order to address the problems of additional length, weight and smoke as presented in these prior art systems the designer of the combustor is moved to design the combustor to include as much injector air in the front end of the combustor as could be tolerated. These high shear swirlers as presented in these referenced prior art patent and patent applications include an outer annulus shear zone to atomize the fuel. Such injectors have been developed with effective air flow areas (ACd) that are as high as 0.80 square inches. As noted FIGS. 2*a*, 2*b*, 2*c* and 2*d*, which are a series of graphs, demonstrate the effect that ACd injector has on smoke, nitrous oxide (Nox), Pattern Factor and Flame Stability. It will be appreciate that overall smoke levels, exit temperature pattern factor and nitrous oxide emissions decrease significantly as ACd rises. However, increased injector air at the front end of the combustor also produces a flame that is inherently prone to flame blowout at low power conditions.

As understood by those skilled in this art, these prior art systems exemplified by the referenced patent and patent applications, supra, the solution to the idle stability problem and the desired high power performance introduced a dilemma. One solution to this dilemma is to use multi-zones having a low power fuel nozzle to enhance the stability of the combustor. These multi-zone fuel injection systems, as these prior art systems have become to be known as, created a relatively rich burning region in the "pilot zone" of the combustor which was needed to provide a good idle stability margin. At high power conditions, the secondary zone or "main" zone in the combustor is fueled to prevent the formation of excessive smoke and Nox. When operating in a dual-zone mode, as is the case when a pilot zone and main zone are utilized, these burners also provide good exit temperature pattern factor. Unfortunately, these dual zone systems introduced complexity in the overall fuel systems. The requirement of the additional set of fuel nozzles in these dual zone systems also increased the weight of the fuel injection system and hence, results in a deficit to the overall engine performance. In comparison with a single-zone conventional combustor the multi-zone fuel injection systems not only introduced complexity in the overall burner or combustor, it also increased its weight.

I have found that I can obviate the complexity and weight problems discussed in the above paragraphs by providing an injector that consists of two assemblies, namely, 1) a burner-mounted swirler with two outer air passages surrounding a concentric ring of air injection holes and (2) a piloted fuel nozzle containing an airblast-atomized main (or secondary) fuel injection annulus and a pilot (or primary) fuel injection orifice, hereinafter referred to for convenience and simplicity as a Multishear Injector. The primary passage of the Multishear Injector provides low-power fuel to the external portions of the injector, promoting good ignition performance and robust stability. The secondary passage of the Multishear Injector provides high-power fuel to the central regions of the injector through an annular fuel injection passage surrounded by concentric swirled air passages. This main fuel assembly provides good atomization and a uniform fuel spray, thus, reducing Nox emissions without incurring a significant increase in smoke. In accordance with this invention the fuel nozzle mounts into the swirler upon final burner assembly when the nozzle pilot tip is accepted through the swirler assembly at a single bearing location.

Results of experimental testing has demonstrated that the preferred embodiment of the Multishear Injector significantly reduced Nox emissions (below the current low-NOx combustors), equivalent idle stability to conventional burners, and reduced smoke emissions relative to all heretofore known systems.

The inventive Multishear injector provides all the benefits of a fully staged burner, good idle stability, lean-blowout stability, low idle emissions, low mid-power emissions, low smoke, low high-power Nox emissions and good altitude lighting, without the associated increase in burner complexity and weight necessary to support integration of two separate fuel injection zones. Also, the external fuel system architecture can be identical to current unstaged burners, which is another significant weight, cost and durability improvement of heretofore known systems.

SUMMARY OF THE INVENTION

An object of this invention is to provide an improved fuel injection system for the combustor of a gas turbine engine.

A feature of this invention is to provide a burner-mount swirler with two outer air passages surrounding a concentric ring of air injection holes and a piloted fuel nozzle containing an airblast-atomized main fuel injection annulus and a pilot fuel injection orifice. This invention is characterizes that it provides good idles stability, lean-blowout stability, low idle emissions, low mid-power emissions, low smoke, low high-power Nox emissions and good altitude lighting without incurring complexity and weight penalties in the system and being less complex and heavy than heretofore known systems designed to accomplish like results.

The foregoing and other features of the present invention will become more apparent from the following description and accompanying drawings.

DETAILED DESCRIPTION OF THE INVENTION

In order to best appreciate and understand this invention reference will be made to FIGS. 1, 2*a–d* and 3 which show different prior art fuel injection/mixer systems and charts describing certain parameter that are required in combustors for gas turbine engines. An understanding of these systems will give insight to the problems confronting the inventor and the solution for solving these problems as will be described in more detail hereinbelow.

Figure 1:
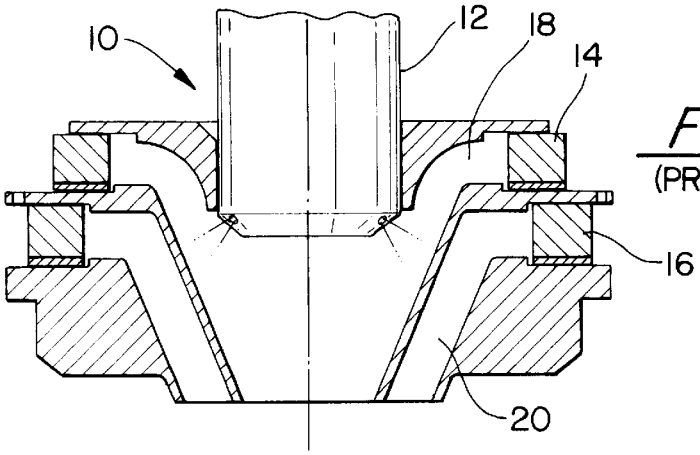
FIG. 1 (PRIOR ART)
FIG. 1 is a longitudinal sectional and partial elevation view of a prior art fuel nozzle/mixer assembly.

As seen in FIG. 1, which is a prior art fuel injector system generally illustrated by reference numeral 10 having a centrally disposed fuel nozzle 12 and a pair of high shear swirler passages 18 and 20. The radial swirler vanes 14 and 16 impart a high vortex to the incoming air that is exited into the front end of combustor (not shown) via swirl passages 18 and 20, respectively, which serves to add as much air as possible. The high shear swirl vanes 14 and 16 and swirl passages create an outer annulus shear zone which serve to atomize the fuel. These fuel/mixers injectors have been developed by the Assignee with effective ACd as high as 0.80 square inches and while these systems have the advantages shown in FIGS. 2*a–c* because of the increased injector ACd these systems are also prone to flame blowout at the low-power conditions.

Figure 3:
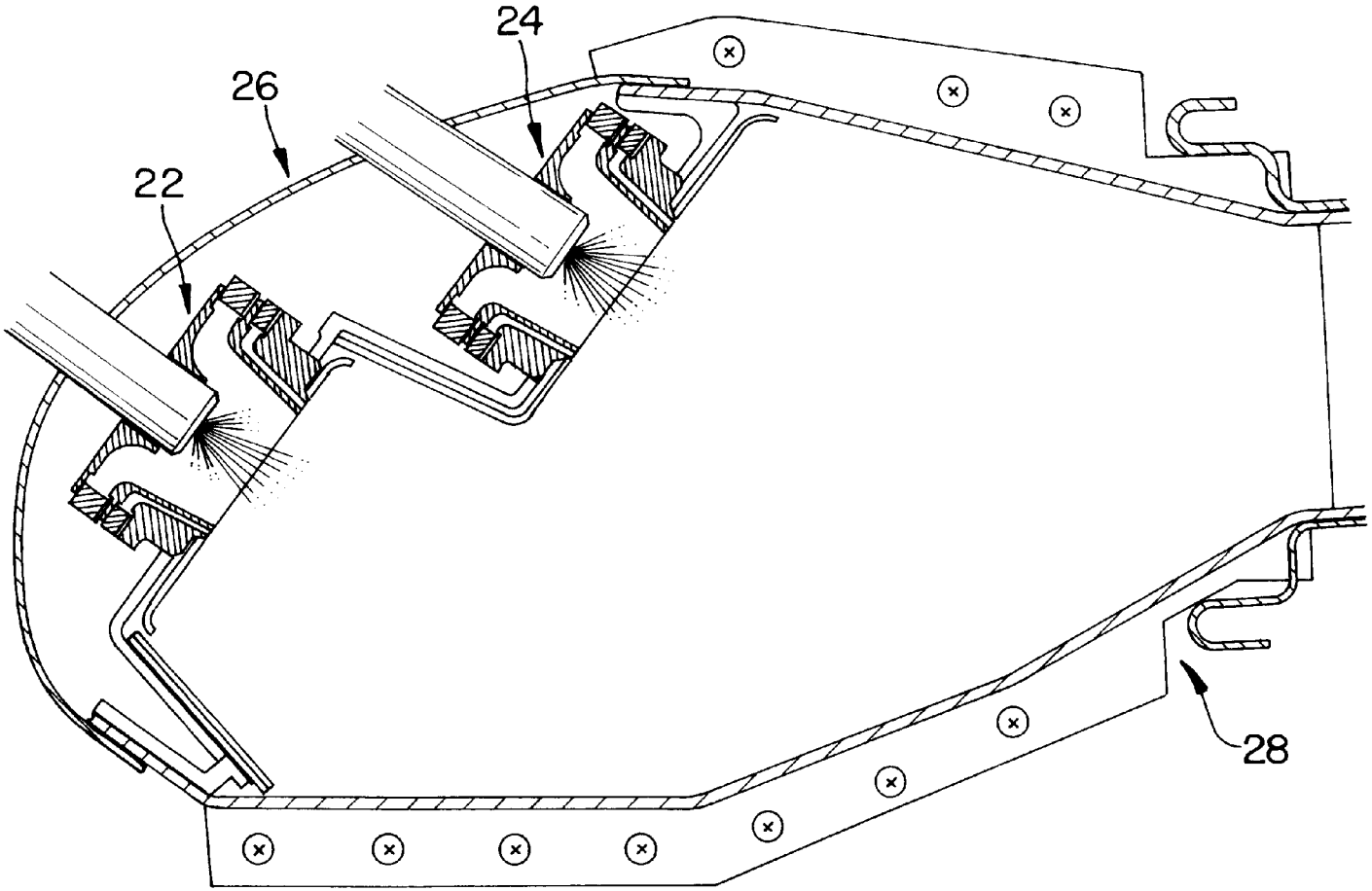
FIG. 3 (PRIOR ART)
FIG. 3 is a partial view in elevation, section and schematic illustrating a prior art dual-zone combustor.

To compensate for the instability of the flame at the low-power conditions, the designer has developed the multi-zone systems, as shown in FIG. 3, which is a prior art configuration. In this embodiment two fuel/mixer ejectors 22 and 24, similarly configured as the single fuel/mixer injector 10 FIG. 1 are mounted in the dome 26 of the annular combustor 28. The annular combustors are well known and for further details reference should be made to the combustors used in the JT9D, PW2000 or PW4000 engines manufactured by the Pratt & Whitney division of United Technologies Corporation, the assignee of this application and U.S. Pat. No. 4,912,922. The particular construction of the combustion chamber is not important to this invention and suffice it to say that the fuel/mixer injector is mounted in the front end of the combustor where fuel and air are admitted, burned to accelerate the working medium of the engine and exited at the aft end of the combustor for powering the turbines of the engine. As noted from FIG. 3 the "pilot zone" provides a relatively rich burning region to provide good idle stability margin. At high power conditions, the main zone is fueled to prevent the formation of excessive smoke and NOx. This system provides good exit temperature pattern factor when operating in the dual-mode. The disadvantage of the multi-zone burners lies in its complexity of the fuel system relative to conventional, single zone combustor and the increased weight and complexity of the additional set of fuel nozzles and mixers.

Figure 2A:
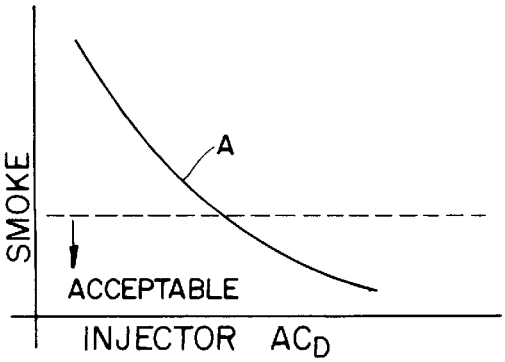
FIG. 2a (PRIOR ART)
FIG. 2*a* is a chart of smoke plotted against injector ACd.
Figure 2C:
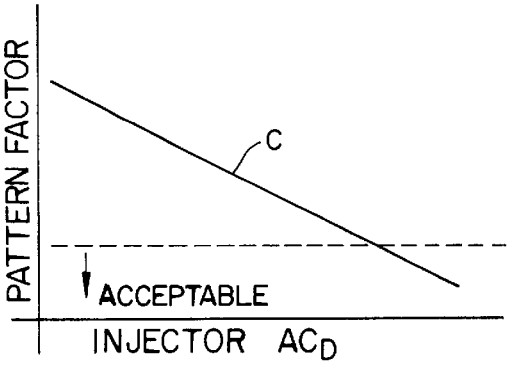
FIG. 2c (PRIOR ART)
FIG. 2*c* is a chart of pattern factor plotted against injector ACd.
Figure 2B:
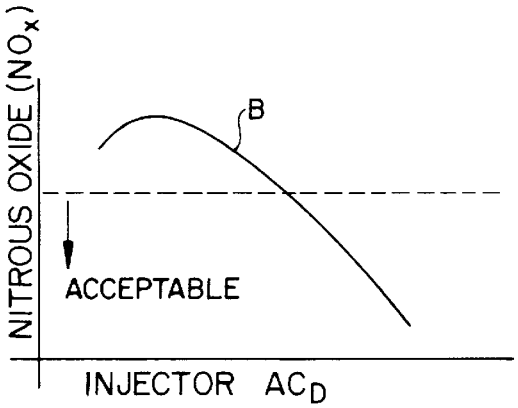
FIG. 2b (PRIOR ART)
FIG. 2*b* is a chart of nitrous oxide (Nox) plotted against injector ACd.
Figure 2D:
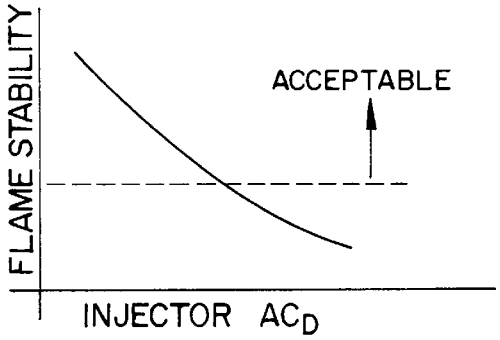
FIG. 2d (PRIOR ART)
FIG. 2*d* is a chart of flame stability plotted against injector Acd.

As best seen in curves A, B, and C of FIGS. 2*a–c*, the smoke, NOx, and Pattern Factor, respectively improve as injector ACd increases and curve D shows that the flame stability decreases as the injector ACd increases. As noted in FIG. 2*d*, as the injector ACd rises the flame becomes more prone to blowout at low-power conditions, a condition that cannot be tolerated. Thus, overall smoke levels, exit temperature pattern factor and nitrous oxide emissions decrease significantly as injector ACd rises. It will be appreciated that the Nox pollutant that contributes to urban smog and ozone depletion is a pollutant that will be regulated in the not too distant future and the combustor will be, of necessity, designed to meet certain standards. It also will be appreciated that increased injector air also produces a flame that is more prone to blowout at low-power conditions.

Figure 4:
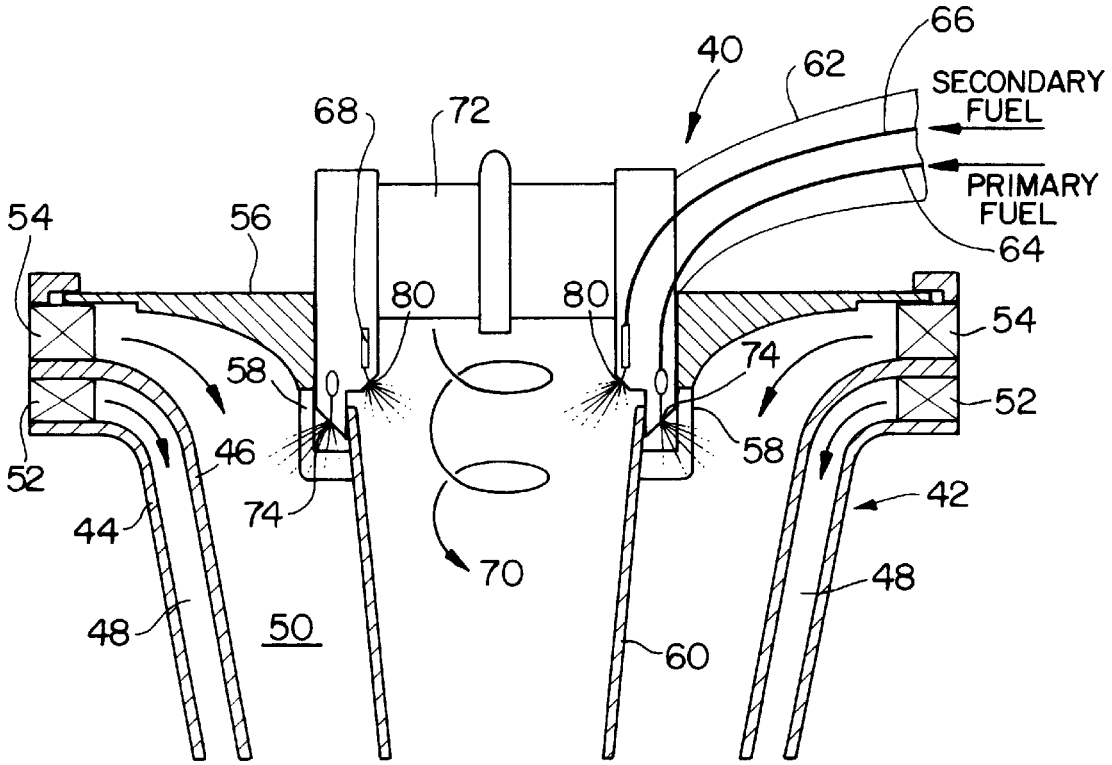
FIG. 4 is a longitudinal view partly in section, in elevation and schematic illustrating a preferred embodiment of this invention.

According to this invention and as best seen in FIG. 4, a Multishear fuel injector generally illustrated by the reference numeral 40 is mounted in the dome of the combustor of the type referred to in the above paragraph. Of importance to this invention is that the Multishear fuel injector is mounted in the front end of the combustor for injecting fuel and air in the combustion zone of the combustor. As noted, the Multishear fuel injector of this embodiment consists of the outer swirler assembly 42 comprising the generally conical walls 44 and 46 spaced to define the swirl passages or ducts 48 and 50 respectively. As in the embodiment of FIG. 1, the outer swirler assembly carries the radial inflow swirl vanes 52 and 54 for introducing high swirling air to the front end of the combustor and functions similarly thereto. The outer swirl assembly 42 is mounted to the nozzle bearing plate 56.

The nozzle bearing plate 56 carries a plurality of circumferentially spaced support members or bridges 58 that supports the conically shaped central wall or duct 60. It is important that the bridges 58 are judiciously oriented between fuel nozzle radial jet injection holes or ports of the fuel nozzle 62 to provide proper filming of the primary fuel spray on the central wall 60 and prevent the formation of coke on these bridges 58. Fuel nozzle 62 mounts on the bearing plate 56 and contains two fuel passages 64 and 66, where fuel passage 64 is the primary fuel passage and passage 66 is the secondary fuel passage. The aft end of the fuel nozzle 62 is formed in an annular or torroidal portion 68 spanning the inner and central passage 70 formed by the central conical wall 60. A central swirl vane 72 is formed integrally in the fuel nozzle 62 in the inner space of the annular portion 68 and serves to impart a swirling motion to the air introduced into the front end of the combustion chamber via the central passage 70.

The primary passage 64 provides low-power fuel via the fuel nozzle orifices or ports 74 formed in the exit end of the fuel nozzle 62. The fuel injected from these orifices mixes with the air in swirl passage 50 which is at the external portion of the injector. This mixed fuel/air exiting from passage 50 promotes good ignition performance and robust stability of the flame in the combustion zone. It is contemplated that either an axisymmetrical radial jet pattern or skewed pattern can be used in the primary zone. To obtain a skewed pattern one of the radial jet passages in the primary fuel nozzle orifices 74 is made larger which will further enhance local flame stability. The fuel nozzle 62 mounts into the swirler assembly 42 when the nozzle pilot tip is accepted through the swirler assembly at a single bearing location.

The secondary passage 66 provides high-power fuel by flowing fuel via orifices 80 formed in the exit end of the fuel nozzle 62 to mix with the swirling air in passage 70 and exit into the front end of the combustor. Because the secondary fuel is in close proximity to the primary flame no special ignition devices are needed for the secondary fuel. This will be true no matter what flow rates are encountered. The selection of the fuel orifices for the secondary fuel will be predicated on the atomizing effectiveness of the inner mixing assembly. It is contemplated that the secondary fuel can be injected via radial jet holes, an annular orifice or other applicable injection methods.

A Multishear fuel injection system as described in the immediate above paragraph is capable of attaining an Acd greater than 1.00 without degrading the flame stability. An injector of this size will require a fuel nozzle inner passage diameter of approximately 1.1 inches, translating to a total nozzle diameter of approximately 2.0 inches. This is well within the envelope size of the modern airblast types of fuel nozzles. It is contemplated that the Multishear fuel injection system will promote a low-smoke, low exit temperature pattern factor, short length burner design that will be compatible with future military fuel-loading requirements and will significantly reduce NOx formation necessary to meet Federal standards for commercial operating conditions.

Figure 6:
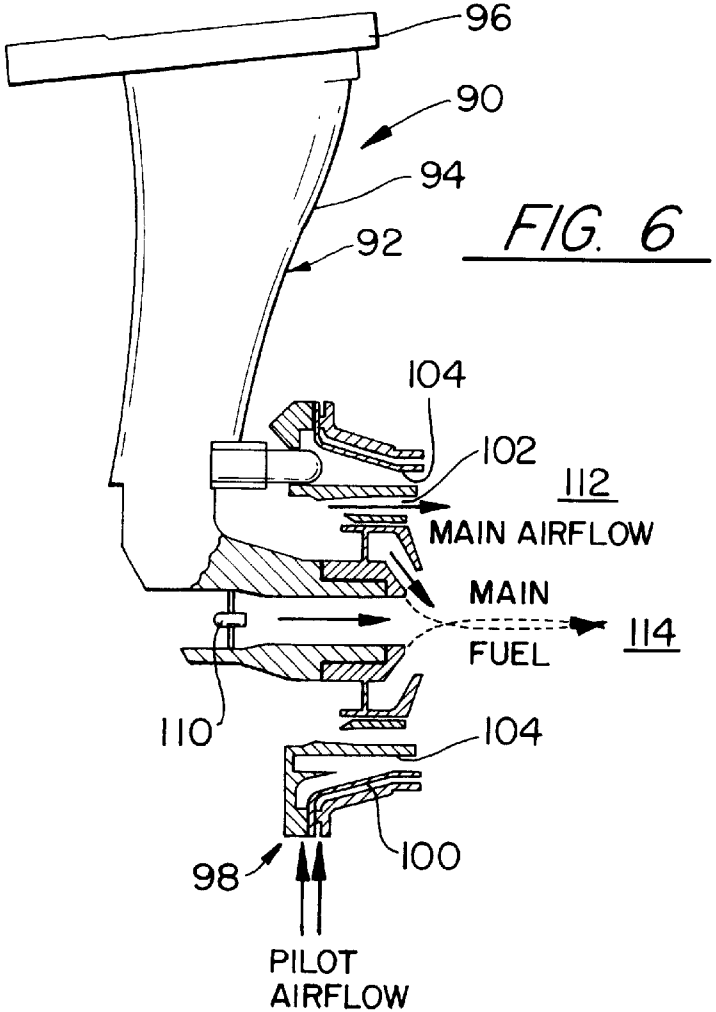
FIG. 6 is a longitudinal view partly in elevation and section of the embodiment of FIG. 5 illustrating the details of this invention.
Figure 5:
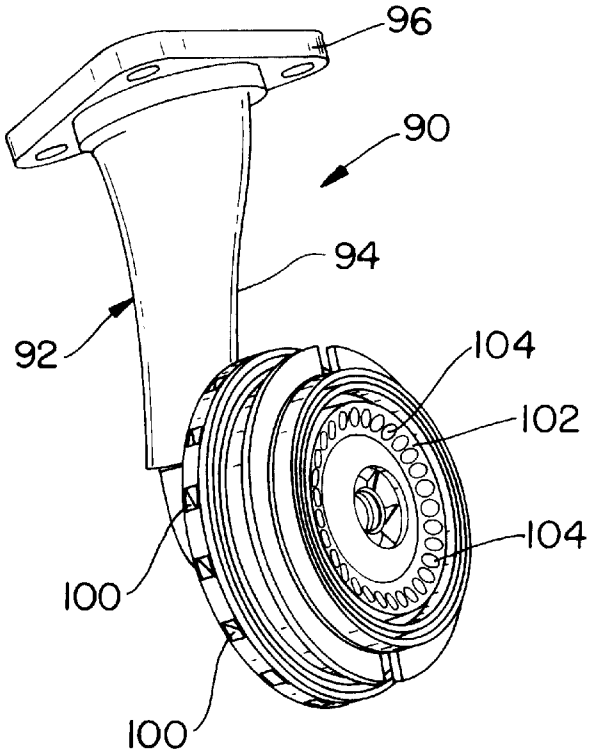
FIG. 5 is a perspective view of another embodiment of the invention.

In an alternate embodiment of this invention as depicted in FIGS. 5 and 6, the Multishear Injector generally illustrated by reference numeral 90 consists of the main fuel nozzle 92 having a main body 94 and base member 96 for attachment to the engine and mounting the fuel nozzle in the front end of the combustor as described in the above paragraphs. Similar to the outer swirler assembly 42 of FIG. 4, an outer swirler assembly 98 for introducing high swirl air to the front end of the burner through passage 100 and a concentric ring 102 with a plurality of concentrically spaced air injection holes 104.

The fuel nozzle contains an airblast atomized main fuel injection annulus 110 (secondary fuel) and a pilot fuel injection port 104 (primary fuel) with single or multiple fuel injection orifices. The primary passage provides low-power fuel to the external portions 112 of the injector for promoting good ignition performance and robust stability. The secondary passage provide high-power fuel to the central region 114 of the injector through the annular fuel injection passage surrounded by the concentric swirled air passages. This main fuel assembly provides good atomization with uniform fuel spray, thus, reducing Nox emissions without incurring a significant increase in smoke.

What has been shown by this invention is a fuel/air mixer injector or the Multishear injector that provides all the benefits of a fully staged burner, good idle stability, lean-blowout stability, low idle emissions, low mid-power emissions, low smoke, low high-power Nox emissions and good altitude lighting without the associated increase in burner complexity and weight necessary to support integration of two separate fuel injections zones. Also the external fuel system architecture can be identical to current unstaged burners, which is another significant weight, cost and durability improvement.

Although this invention has been shown and described with respect to detailed embodiments thereof, it will be appreciated and understood by those skilled in the art that various changes in form and detail thereof may be made without departing from the spirit and scope of the claimed invention.

It is claimed:

1. In combination, a fuel nozzle, a source of fuel and a source of air, and a first swirler and a second swirler for mixing the fuel discharging from the fuel nozzle with the air in the swirlers for admission in a burner for a gas turbine engine, said fuel nozzle having a primary fuel passage and a primary discharge port disposed at the end of said primary fuel passage and a secondary fuel passage and a secondary discharge port disposed at the end of said secondary fuel passage, said fuel nozzle disposed centrally of said first swirler, said first swirler having a generally conically shaped wall defining a first central duct admitting air from said source to flow therein and said second swirler having a second generally conically shaped wall defining a second central duct admitting air from said source to flow therein, said second central duct coaxially located relative to said first central duct and surrounded by said first central duct, said primary fuel port discharging fuel radially outwardly into said first central duct and adjacent to said second conically shaped wall to admit fuel from said fuel source to mix with the air therein and said secondary fuel port discharging fuel radially inwardly into said second central duct and adjacent to said second conically shaped wall to admit fuel from said fuel source to mix with the air therein, wherein the primary fuel being supplied during low power conditions of said gas turbine engine and said secondary fuel being supplied at higher power conditions of said gas turbine engine.

2. The combination as claimed in claim 1 including a nozzle beating plate supporting said fuel nozzle and said second central duct disposed adjacent said second conically shaped wall, a plurality of circumferentially spaced bridge members affixed to said nozzle bearing plate supporting said second central duct, said primary fuel port disposed between openings between said circumferentially spaced bridge members.

3. The combination as claimed in claim 2 including a third central duct surrounding said first central duct and said second central duct, said third central duct introducing solely air into the burner.

4. The combination as claimed in claim 3 wherein said first central duct, said second central duct and said third central duct terminating in a common plane.

5. The combination as claimed in claim 4 wherein said fuel nozzle includes a torroidal portion, swirl vanes in said torroidal portion for imparting swirl to the air entering said first central duct.

6. The combination as claimed in claim 5 wherein said fuel nozzle includes a plurality of primary discharge ports and each of said primary ports of said primary fuel passage is disposed between openings between said circumferentially spaced bridge members for passing fuel between adjacent bridge members of said plurality of bridge members.

* * * * *